US006614331B2

(12) United States Patent
Haapakoski

(10) Patent No.: US 6,614,331 B2
(45) Date of Patent: Sep. 2, 2003

(54) METHOD OF MANUFACTURING INNER CONDUCTOR OF RESONATOR, AND INNER CONDUCTOR OF RESONATOR

(75) Inventor: Ari Haapakoski, Paavola (FI)

(73) Assignee: Remec Oy, Oulu (FI)

( * ) Notice: Subject to any disclaimer, the term of this patent is extended or adjusted under 35 U.S.C. 154(b) by 0 days.

(21) Appl. No.: 09/725,435

(22) Filed: Nov. 29, 2000

(65) Prior Publication Data

US 2001/0002809 A1 Jun. 7, 2001

(30) Foreign Application Priority Data

Dec. 1, 1999 (FI) ..... 19992581

(51) Int. Cl.[7] ..... H01P 7/04
(52) U.S. Cl. ..... 333/222; 333/202
(58) Field of Search ..... 333/222, 202, 333/234

(56) References Cited

U.S. PATENT DOCUMENTS 4,287,494 A * 9/1981 Hashimoto et al. ..... 333/202
6,114,928 A * 9/2000 Smith ..... 333/202
2001/0002810 A1 * 6/2001 Jokilehto et al. ..... 333/222

FOREIGN PATENT DOCUMENTS

| | | |
|---|---|---|
| EP | 0533394 | 3/1993 |
| EP | 0924790 | 6/1999 |
| WO | 9917394 | 4/1999 |
| WO | 0038270 | 6/2000 |

OTHER PUBLICATIONS

Fritz, A.H et al (Editors) German "Fertigungstechnik". XP–002161323 1990.

* cited by examiner

*Primary Examiner*—Benny Lee
*Assistant Examiner*—Joseph Chang
(74) *Attorney, Agent, or Firm*—Ladas and Parry

(57) ABSTRACT

The invention relates to a method of manufacturing an inner conductor of a resonator, and an inner conductor of a resonator comprising a first end and a second end, which is free. The inner conductor is deep-drawn from a uniform, electrically conductive blank.

14 Claims, 4 Drawing Sheets

METHOD OF MANUFACTURING INNER CONDUCTOR OF RESONATOR, AND INNER CONDUCTOR OF RESONATOR

FIELD OF THE INVENTION

The invention relates to manufacturing an inner conductor of a resonator.

BACKGROUND OF THE INVENTION

Resonator structures of a high frequency area, a radio frequency area in particular, are used e.g. in base stations of mobile telephone networks. Filters may utilize resonator structures e.g. as adapting and filtering circuits in transmitter and receiver units of the base stations.

A resonator structure comprises an inner conductor of the resonator attached to an attachment surface, which in practice most often is an end, such as a bottom or a cover, of a housing structure serving as an outer conductor of the resonator structure. The inner conductor is thus short-circuited to the attachment surface, i.e. in practice to the outer conductor. A short-circuited end of the inner conductor, at which the inner conductor is thus short-circuited to the outer conductor, is also called an inductive end owing to the fact that signal coupling at the short-circuited end is mainly carried out inductively.

At a second end of the inner conductor, the inner conductor is galvanically separated from the outer conductor, so this end is the "free" end of the inner conductor. The free end of the inner conductor is also called a capacitive end of the inner conductor owing to the fact that signal coupling at this end is mainly carried out capacitively. The outer conductor and the inner conductor located within a section defined by the outer conductor together form a resonance circuit. In practice, the resonator structures often comprise a plurality of circuits, i.e. the resonator structure comprises several pairs comprising an inner conductor and an outer conductor, i.e. each section formed by the outer conductor comprises a separate inner conductor. The resonance circuits of a multi-circuit resonator structure together form a desired frequency response for the resonator structure.

Normally in a coaxial resonator, the inner conductor of the resonator is a straight wire or a pin attached only to the bottom of the resonator. Such a resonator is long and thus takes a lot of space. The resonator pin is quite easy to manufacture. The problem then is, however, how to adjust the coupling of the resonator since it is difficult to attach such a controlling element to the resonator pin that would enable the resonator to be easily coupled to e.g. an adjacent resonator. Furthermore, the capacitive coupling provided by the wire-like inner conductor is poor.

In order to decrease the space required by the resonator, for instance a helix coil is used as the inner conductor, in which helix coil the same operational length fits into a shorter space since the resonator in the helix resonator is formed as a coil. The helix coil is, however, difficult to manufacture. A further drawback is that it is extremely difficult to attach to the helix coil a coupling wire or other such projection necessary when the coupling between two resonance circuits is to be adjusted. A further problem with the helix resonators is the difficulty to support them and carry out the temperature compensation. An inner conductor implemented by utilizing a helix coil cannot provide a high-quality capacitive coupling.

A known solution for controlling the resonance frequency of a resonator circuit is a solution wherein an adjuster bolt located in the cover of a filter serves as the frequency controlling element, and the distance of the adjuster bolt with respect to the free end of the resonator located in a section under the cover is adjusted by turning the bolt. The solution is not the best possible one since it requires additional structures on the outer surface of the housing. A further problem is that the adjuster bolt requires that the cover of the filter should be thick or the cover should at least comprise a thicker section to enable threads to be provided on the cover for the adjuster bolt, or, alternatively, to enable a nut-like part with threads attached to the cover to be used. The cover has to be thick particularly because it also needs to be rigid in order to prevent the distance of the frequency controlling element in the cover with respect to the resonator from changing after the controlling procedure and from further causing the capacitance, and thus the resonance frequency, to change in an undesired manner.

BRIEF DESCRIPTION OF THE INVENTION

An object of the invention is thus to provide a method of manufacturing an inner conductor of a resonator, and an inner conductor so as to enable the above-mentioned problems to be alleviated. This is achieved by a method disclosed in the introduction, characterized by manufacturing at least part of the inner conductor from a uniform, electrically conductive material blank by utilizing a deep-drawing method wherein the blank is struck or pressed with a tip of an impact device, whereby during each stroke or pressing, the tip draws more and more blank material in the direction of the stroke.

The invention further relates to an inner conductor of a resonator comprising a first end and a second end, which is free.

The inner conductor of the invention is characterized in that at least part of the inner conductor is deep-drawn from a uniform, electrically conductive blank.

Preferred embodiments of the invention are disclosed in the dependent claims.

The idea underlying the invention is that the inner conductor is manufactured by utilizing a deep-drawing method.

Several advantages are achieved by the method and inner conductor of the invention. The deep-drawing method enables the inner conductor and a flange located at the free end thereof to be manufactured virtually simultaneously. In addition, a potential projection or a site for the same can be manufactured in connection with manufacturing the inner conductor. The drawing method is a quick and low-cost way to manufacture inner conductors. The drawing method enables flanges and projections for the inner conductors to be manufactured that are all integrated in the same uniform material piece. Therefore, the inner conductor is mechanically strong.

Since the inner conductor is deep-drawn, the surface of the inner conductor is extremely smooth, which enables the inner conductor to be readily coated e.g. with silver. Thanks to the smoothness of the surface, the surface area to be coated is smaller than it would be if the surface was uneven. It thus takes less coating material to coat an even surface than an uneven one.

An inner conductor manufactured by utilizing the deep drawing method has a small surface resistance, so the electric loss of the resonator remains small and the Q factor of the resonator can be retained good.

A further advantage of the deep drawing method is that the inner conductor can be manufactured e.g. from a copper blank, in which case the resulting inner conductor does not necessarily have to be coated. The inner conductor manufactured of copper is attached by a specific sleeve, which means that the inner conductor made of copper does not have to be mechanized for the screw threads in a fixing screw.

Since it is possible to attach the inner conductor by a sleeve, the thickness of the walls of the inner conductor can be retained small, which gives a lightweight inner conductor. The advantage provided by the inner conductor being light is that it is highly tolerant e.g. of vibration. Consequently, external vibration does not easily cause the inner conductor to move or become detached. The structure and attachment of the inner conductor thus enable intermodulation noise to be reduced.

BRIEF DESCRIPTION OF THE DRAWINGS

The invention is now described in closer detail in connection with the preferred embodiments and with reference to the accompanying drawings, in which.

DETAILED DESCRIPTION OF THE INVENTION

Figure 1:
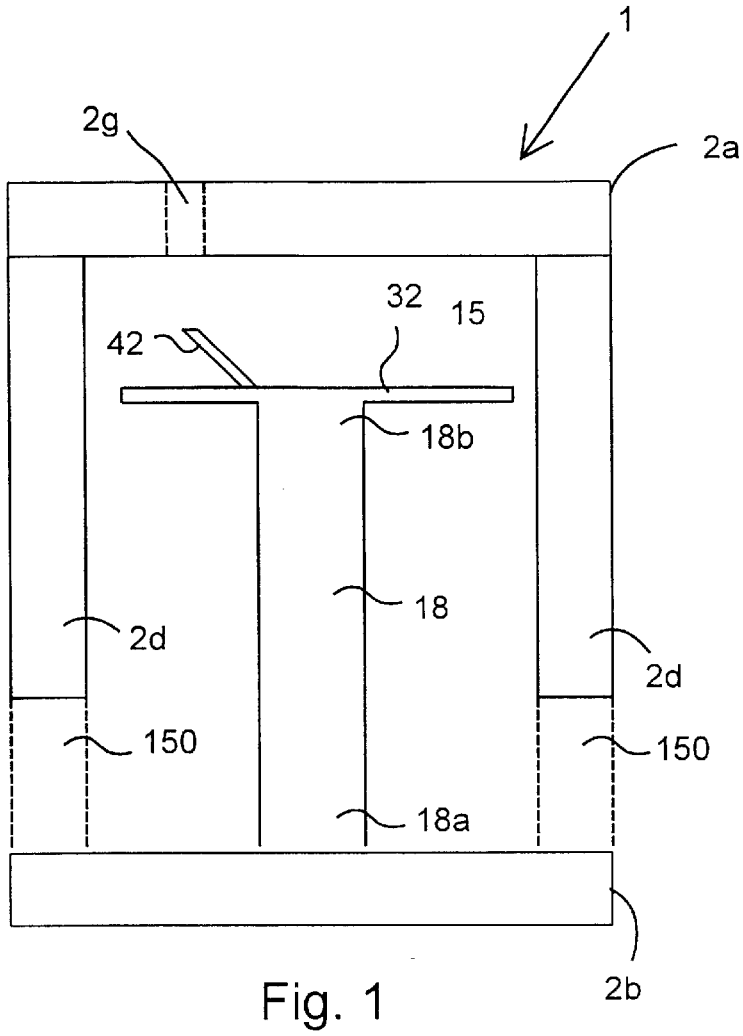
FIG. 1 shows a resonator comprising an inner conductor of the invention.

FIG. 1 shows a resonator 1 comprising a housing structure made of a conductive material and comprising walls 2*a*, 2*b*, 2*d* forming a section 15. The resonator further comprises in the housing structure at least one inner conductor 18 of the resonator made of a conductive material and located in the section 15. The resonator forms a resonance circuit. As its extreme ends, the inner conductor 18 comprises a first end 18*a* and a second end 18*b*, which is preferably the free end 18*b*, i.e. the end which is not short-circuited. The inner conductor 18 is at least partly manufactured by deep-drawing. The resonator structure is preferably used in e.g. resonator filters.

The first end 18*a* of the inner conductor 18 of the resonator refers to the area of the resonator from which the resonator is attached to the bottom of the section 15 thereof, i.e. a bottom 2*b* of the housing structure, the bottom representing the ground potential like the rest of the housing structure 2*a*, 2*b*, 2*d*. The second end of the resonator, such as the free end 18*b*, is in turn directed towards the housing structure 2*a*. To be more precise, the free end is most preferably directed towards a cover 2*a* of the housing structure, i.e. the cover 2*a* of the section, which comprises at least one aperture 2*g*. Through the aperture, a tool can be placed inside the housing to control the resonator.

The free end 18*b* of the inner conductor 18 of the resonator is located at a short distance from the cover 2*a*. The distance is preferably 2 to 10 mm. If necessary, the free end 18*b* can be supported against the cover 2*a* of the housing by a device, provided that the device is not electrically conductive.

Figure 2:
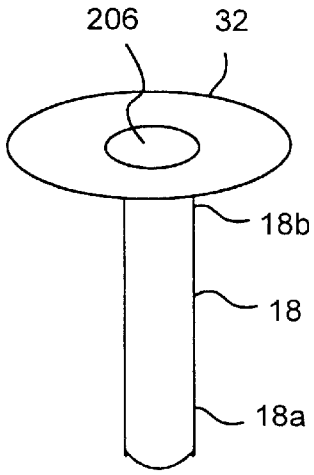
FIG. 2 shows a first preferred embodiment of the inner conductor.

FIG. 1 shows that the inner conductor 18 of the resonator comprises at the free end 18*b* a device 32 whose surface is directed towards the housing structure 2*a*. FIG. 2 shows the shape of the device 32 in greater detail.

As seen from the direction of the cover 2*a*, the device 32 preferably has a circular shape. The device 32 is preferably located closer to the free end than the short-circuited first end 18*a* coupled to the bottom 2*b* which is in the ground potential. It can also be seen from FIG. 2 that the device 32 comprises an opening 206 traveling from the free end 18*b* of the inner conductor all the way to the end 18*a* at least partly through the inner conductor 18 manufactured by deep-drawing.

The device 32 increases the surface area of the inner conductor of the resonator. The surface of the device 32 is directed towards the housing structure 2*a*. An increase in the cross-sectional area increases the capacitance between the area next to the second end 18*b* of the inner conductor of the resonator and the housing structure 2*a*. According to a known formula, the increase in capacitance has a lowering effect on resonance frequency, which enables the increase in resonance frequency otherwise caused by the shortening of the inner conductor of the resonator to be compensated for. The surface area of the device 32 directed towards the housing structure 2*a* is preferably larger than the cross-sectional area of the inner conductor 18 of the resonator. It is further to be noted that the device 32 and the inner conductor 18 of the resonator are manufactured from the same material piece. In practice, the device 32 is manufactured in connection with manufacturing the inner conductor 18 of the resonator.

Furthermore, the resonator 1 comprises a frequency controlling element 42 made of a conductive material for controlling the resonance frequency of the resonance circuit. The frequency controlling element 42 is a part of the same integrated whole comprising the inner conductor of the resonator and the device 32. The frequency controlling device 42 is a projection 42 projecting from the device 32, and the resonance frequency of the resonance circuit can be controlled by adjusting the distance of the projection 42 with respect to the housing structure 2*a*. The frequency controlling element 42 can be a narrow material strip manufactured from the same material piece as the inner conductor 18 of the resonator 1. In practice, the frequency controlling element 42 is manufactured in connection with manufacturing the inner conductor 18 of the resonator 1. The frequency controlling element 42 is made of an electrically conductive material.

Figure 3:
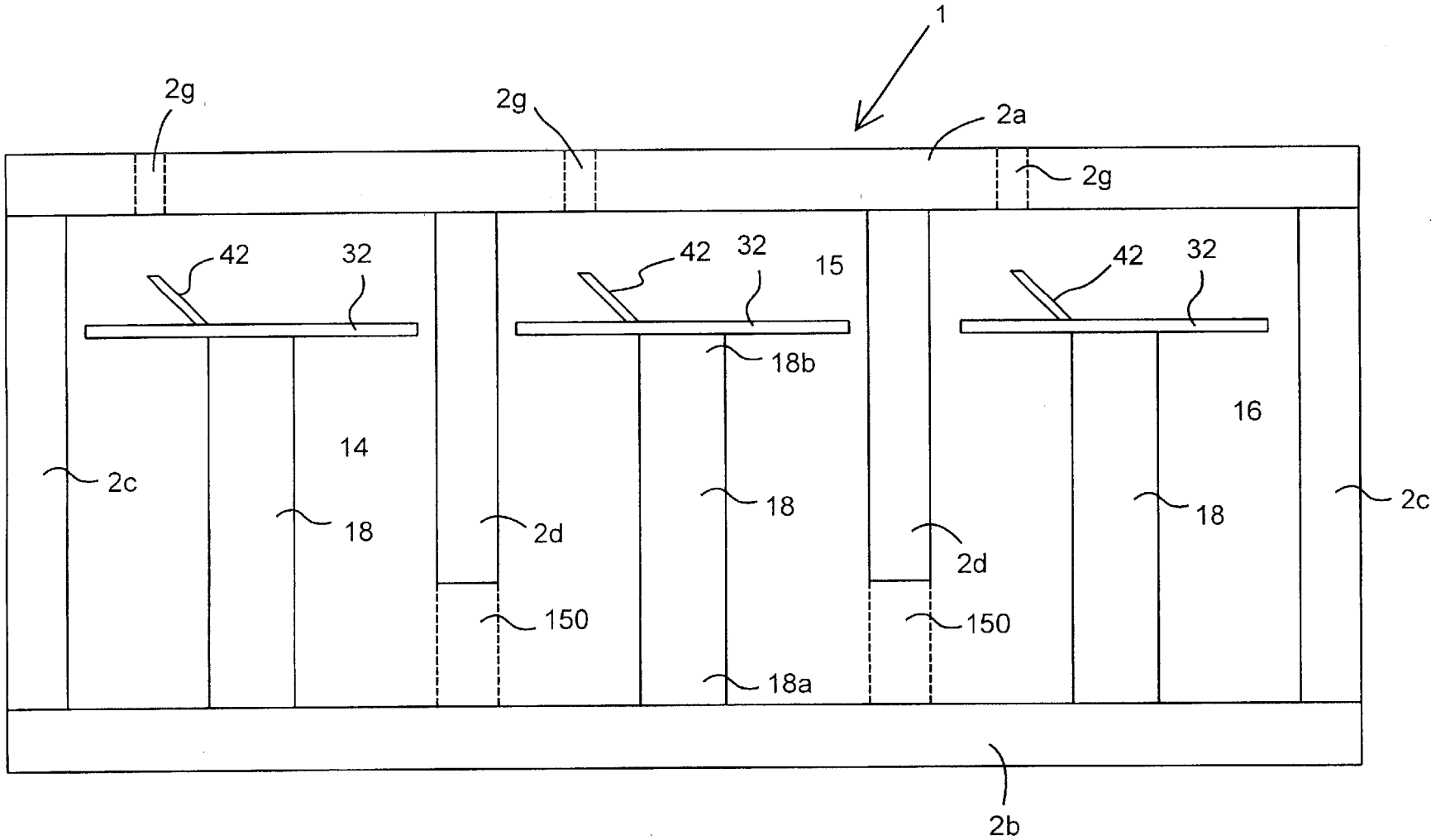
FIG. 3 shows a resonator structure.

FIG. 3 shows a resonator structure comprising three resonators coupled to each other. The resonator structure may serve as a filter, for example. The resonator structure comprises a housing structure 2*a* to 2*d* made of a conductive material and comprising sections 14, 15 and 16. Each resonator comprises a separate inner conductor 18 manufactured by deep-drawing.

FIG. 3 shows that the resonator structure comprises a coupling aperture 150 in the wall 2*d* between the sections 14 and 15 through which the resonators in the sections 14 and 15 are enabled to be coupled to each other. The resonator structure further comprises a coupling aperture 150 in the wall 2*d* between the sections 15 and 16 through which the resonators in the sections 15 and 16 are enabled to be coupled to each other.

FIG. 3 shows that each inner conductor 18 comprises a separate device 32 for increasing the cross-sectional area of the inner conductor of the resonator. In addition, each inner conductor 18 comprises a separate element 42. The device 32 is shaped like a sheet or a plane. The device 32 can be assumed to form a first electrode of a capacitor. A second electrode of the capacitor is formed by the cover 2*a* of the housing. The device 32 is made of metal or some electrically conductive mixture. The device 32 typically has a thickness of a few millimeters at most. The surface of the device 32 is preferably at an angle of 90 degrees with respect to the longitudinal axis of the inner conductor.

As was stated above, the frequency controlling element 42 located in the inner conductor of the resonator can be used for controlling the resonance frequency of the resonance circuit. The frequency controlling element 42 is manufactured from the same integrated whole as the device 32 attached to the inner conductor of the resonator. The resonance frequency of the resonance circuit can be controlled when the distance of the frequency controlling device 42 projecting from the device 32, i.e. the projection, with respect to the housing structure is changed.

The inner conductor of the invention can be used e.g. in resonator filters used e.g. in radio transmitters, receivers or transceivers, such as base stations in a cellular radio network. In such a case, it is obvious that the resonator filter also has a connection to an antenna, and an RX connection, from which the signal is supplied to a receiver of a base station, and a TX connection, to which the signal is supplied from e.g. a transmitter of the base station. The present invention can also be applied to another radio transceiver or device than the base station of a cellular radio network.

Figure 4A:
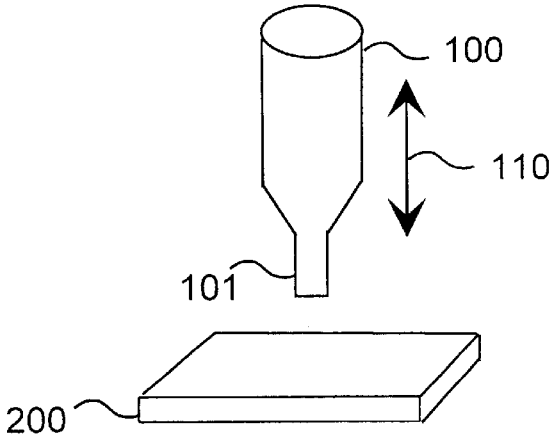
FIGS. 4*a* to 4*d* show a deep-drawing method utilized in manufacturing the inner conductor.

FIGS. 4*a* to 4*d* show the basic idea of a manufacturing process of an inner conductor. FIG. 4*a* shows an impact device 100 performing a to-and-fro motion according to arrow 110. A material piece, i.e. a blank 200, is arranged underneath the device 100 to be machined by the device 100 when a tip 101 of the device strikes the material piece. As a result from the machining, a cavity or a hole is formed in the blank material. The material piece can be brought to the device by a conveyor, for example. The blank can be of a size of 10 cm by 10 cm, for example. The blank is typically less than one millimeter thick.

Figure 4B:
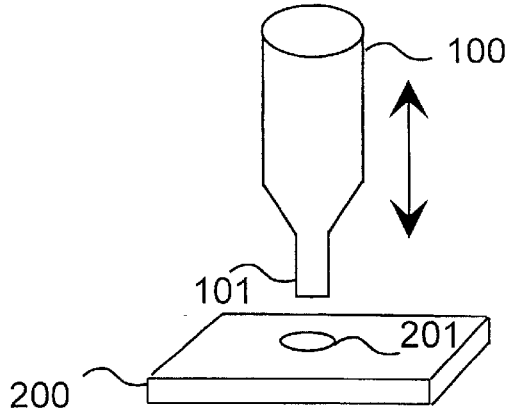

FIG. 4*b* shows that as the tip 101 of the device 100 strikes the material piece, it first forms a small cavity 201 on the upper surface of the piece. As the tip hammers the material piece, it penetrates deeper and deeper into the piece. When the tip 101 strikes the cavity, the tip 101 draws and stretches the material on the edges of the cavity in the direction of the cavity being formed, in which case the thickness of the material changes at the drawing and stretching point.

Figure 4C:
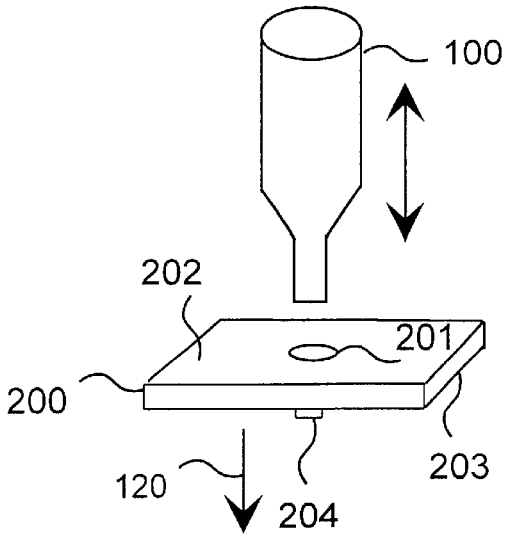

FIG. 4*c* shows that the tip 101 has struck the piece 200 so many times that a short projection 204 has been formed on the lower surface 203 of the piece as a result of the pulling force caused by the strokes. During each stroke or pressing, the tip draws more and more blank material in the direction of the stroke; this is shown by arrow 120.

Figure 4D:
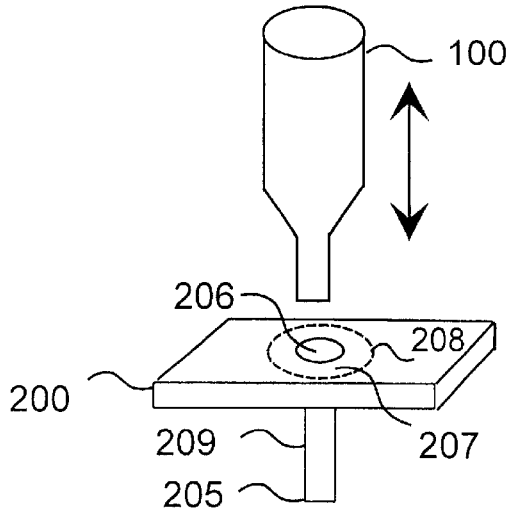

FIG. 4*d* shows that the material projection 204 has reached a desired length, in which case a next blank is arranged underneath the tip 101. In practice, the cavity 201 forms an opening 206 whose first end is located at an end 205 of a projection 209. The projection 209 forms an inner conductor. It is not necessary to manufacture the inner conductor entirely by deep-drawing; however, the inner conductor is preferably manufactured entirely by deep-drawing. FIG. 4*d* further shows a broken line 208 around the opening 206 along which the material piece is, for example, cut off the blank. The material part 207 around the opening 206 forms the device 32, i.e. a flange, in the resonator.

If necessary, some blank material is thus left around the cavity or the hole. About the same amount of blank material is left all around the cavity or the hole. The flange can be cut in the shape of a circle, for example. The flange forms the device 32 for increasing capacitance. The flange can be cut, for example, such that only a narrow strip remains in the flange to be used in controlling the frequency.

Figure 5:
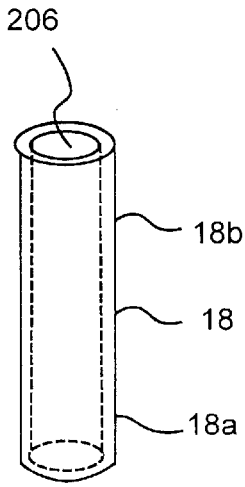
FIG. 5 shows a second preferred embodiment of the inner conductor.

FIG. 5 shows the inner conductor 18 manufactured by deep-drawing and having the shape of a tube or a sleeve. The free end 18*b* of the inner conductor shown in the figure is at least partly open, so a controlling element can be attached thereto if necessary to enable frequency to be controlled, for example. The diameter of the inner conductor may vary in different parts of the conductor.

Figure 6:
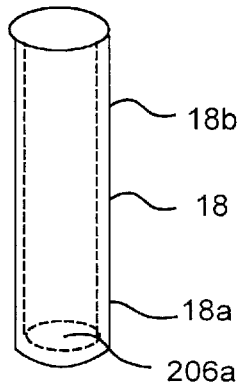
FIG. 6 shows a third preferred embodiment of the inner conductor.

The free end 18*b* of the inner conductor shown in FIG. 5 comprises an opening 206 passing through the first end 18*a* of the inner conductor. FIG. 6, in turn, shows an inner conductor comprising at the first end 18*a* an opening 206*a* which does not, however, pass through the free end 18*b* but the free end is closed.

Figure 7:
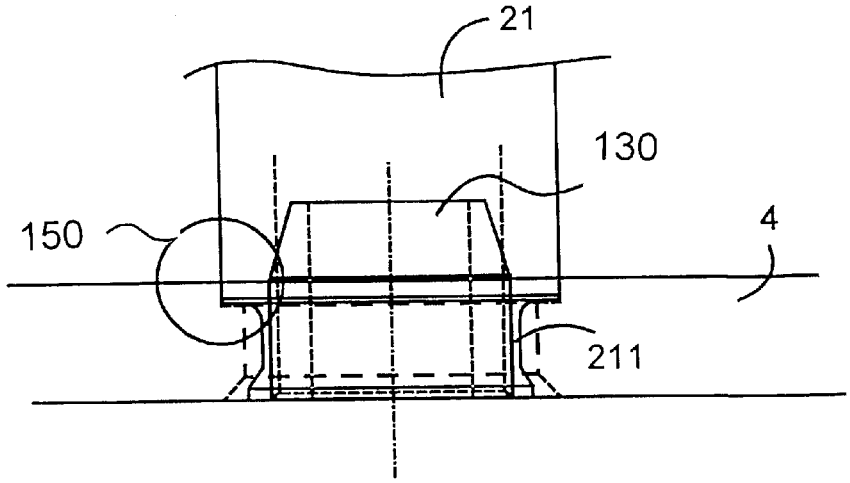
FIG. 7 shows a deformation area.

FIG. 7 shows an inner conductor 21 manufactured by utilizing the deep drawing method and located in the opening passing through an attachment surface structure 4. The inner conductor 21 is attached to the attachment surface structure 4 by an expander 130 brought inside the inner conductor, which in practice is the cavity shown in FIG. 6, through the opening passing through the attachment surface structure 4. A wall 211 of the inner conductor is pressed against the rim of the opening passing through the attachment surface structure 4. The expander is a sleeve.

Figure 8:
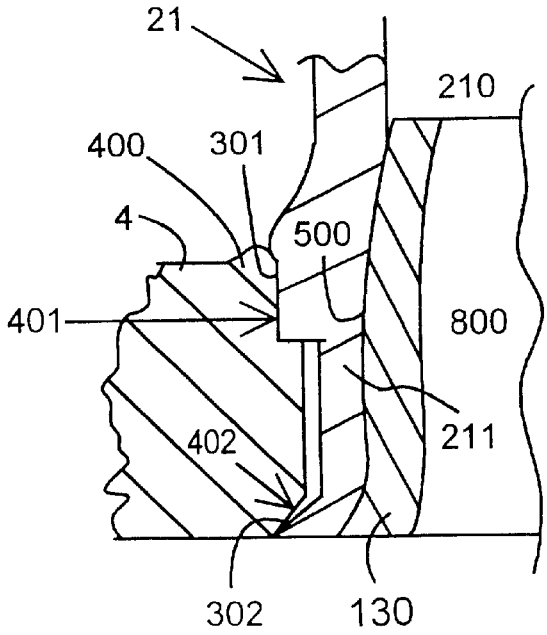
FIG. 8 shows the deformation area in closer detail.

FIG. 8 shows point 150 of the inner conductor 21 shown in FIG. 6 in closer detail. In said embodiment, the attachment of the inner conductor is carried out such that the wall 211 of the inner conductor 21 surrounding an inside area 210 of the inner conductor 21 is pressed against the rim of the opening passing through the attachment surface structure 4 only over a section of the passing-through area where the wall 211 surrounding the inside area 210 of the inner conductor 21 and the rim of the opening passing through the attachment surface structure meet.

In a preferred embodiment, the attachment of the inner conductor is such that the wall 211 of the inner conductor 21 surrounding the inside area 210 is pressed by the expander 130 against the rim of the opening passing through the attachment surface structure 4 to the attachment surface 4 on the side facing the inner conductor 21. The aforementioned pressing point is denoted as a pressing point 301 in FIG. 8. Furthermore, in a preferred embodiment, the other side may also be tightened as well, so a second pressing point 302 is thus located on the opposite side of the attachment surface structure to that where the inner conductor is located.

FIG. 8 further shows that one or more points 401, 402 are provided between the rim of the opening and the wall of the inner conductor where the distance between the rim of the opening and the wall of the inner conductor is shorter than elsewhere. The aforementioned pressing points 301, 302 are thus formed exactly at the heights of the points 401, 402 mentioned above, where said distance is thus at its shortest.

Referring to FIGS. 7 and 8 in particular, it is stated that the diameter of the expander 130, the diameter of the inside area 210 of the inner conductor 21, the outer diameter of the wall 211 surrounding the inside area 210 of the inner conductor 21, and the diameter of the opening passing through the attachment surface structure 4 have been chosen such that the expander 130 arranged in its place generates a deformation 400 in the area surrounding the rim of the opening in the attachment surface structure 4. As to the deformation 400 generated in the attachment surface structure 4 in particular, it can be stated that the deformation 400 does not necessarily have to be a discernible elevation. A deformation 500 is also generated in the wall of the inner conductor surrounding the inside area of the inner conductor.

The expander 130 is flexible in a radial direction, in which case when arranged in place, it generates a tension which does not break structural parts that come into contact with the expander. The expander preferably comprises a longitudinal opening 800 passing therethrough, which makes the expander sleeve-like and, thus, flexible.

Although the invention has been described above with reference to the example according to the accompanying drawings, it is obvious that the invention is not restricted thereto but can be modified in many ways within the scope of the inventive idea disclosed in the attached claims.

I claim:

1. In an inner conductor for a resonator, the improvements comprising a one piece conductive member having a first end, an opposite second end for a free end in the resonator, and a device by the second end having a larger area transverse to an axis of the member between the ends than the second end for affecting capacitance in the resonator, whereby the member can be deep-drawn from a uniform, electrically conductive blank, and an inner conductor wherein at the free end, the inner conductor comprises a plane-like device and an opening extending through the conductor in the longitudinal direction of the inner conductor and located at the free end of the inner conductor.

2. An inner conductor as claimed in claim 1, wherein at the first end, the inner conductor comprises an opening for an expander arranged for attaching the inner conductor.

3. An inner conductor as claimed in claim 1, wherein at the first end, the inner conductor comprises an opening for an expander arranged for attaching the inner conductor such that the expander is used for pressing and attaching a wall of the inner conductor to an attachment structure in a radial direction.

4. An inner conductor as claimed in claim 1, wherein at the first end, the inner conductor comprises an opening for an expander arranged to generate a deformation in order to attach the inner conductor to an attachment structure.

5. An inner conductor as claimed in claim 1, wherein at the free end, the inner conductor comprises a device for increasing capacitance, the device being made of the same material as the inner conductor.

6. An inner conductor as claimed in claim 1, wherein at the free end, the inner conductor comprises a frequency controlling element, which has been deep-drawn in connection with the deep-drawing of the inner conductor.

7. An inner conductor as claimed in claim 1, wherein the inner conductor comprises an opening extending through the conductor in the longitudinal direction of the conductor.

8. An inner conductor as claimed in claim 1, wherein at the free end, the inner conductor comprises a plane-like device and an opening extending through the conductor in the longitudinal direction of the inner conductor and located at the free end of the inner conductor at the middle point of the surface of the device.

9. An inner conductor as claimed in claim 1, wherein the inner conductor comprises a housing structure around it, and at the free end, the inner conductor comprises a plane-like device whose surface is directed towards the housing structure, the surface area of the surface being larger than the surface area of the cross-sectional area of the inner conductor.

10. An inner conductor as claimed in claim 1, wherein the inner conductor is an inner conductor of a high frequency resonator filter.

11. An inner conductor as claimed in claim 1, wherein the inner conductor is located at a resonator filter in a transceiver of a base station.

12. An inner conductor of a resonator, comprising a first end and a second end, which is free, wherein at least part of the inner conductor is deep-drawn from a uniform, electrically conductive blank, wherein the inner conductor is made of an electrically conductive material and at the free end, the inner conductor comprises a substantially plane-like, deep-drawn device manufactured from the same material piece as the inner conductor, and an inner conductor wherein at the free end, the inner conductor comprises a plane-like device and an opening extending through the conductor in the longitudinal direction of the inner conductor and located at the free end of the inner conductor.

13. An inner conductor of a resonator, comprising a first end and a second end, which is free, wherein at least part of the inner conductor is deep-drawn from a uniform, electrically conductive blank, wherein at the free end, the inner conductor comprises a frequency controlling element, which is manufactured from the same material piece as the inner conductor, and an inner conductor wherein at the free end, the inner conductor comprises a plane-like device and an opening extending through the conductor in the longitudinal direction of the inner conductor and located at the free end of the inner conductor.

14. An inner conductor of a resonator, comprising a first end and a second end, which is free, wherein at least part of the inner conductor is deep-drawn from a uniform, electrically conductive blank, wherein at the free end, the inner conductor comprises a device for increasing capacitance, the device being deep-drawn at the same time as the inner conductor, and an inner conductor wherein at the free end, the inner conductor comprises a plane-like device and an opening extending through the conductor in the longitudinal direction of the inner conductor and located at the free end of the inner conductor.

* * * * *